US009635890B2

(12) United States Patent
Monica

(10) Patent No.: US 9,635,890 B2
(45) **Date of Patent: *May 2, 2017**

(54) PROTECTIVE EQUIPMENT

(71) Applicant: XTECH Protective Equipment LLC, East Hanover, NJ (US)

(72) Inventor: Theodore Anthony Monica, East Stroudsburg, PA (US)

(73) Assignee: XTECH Protective Equipment LLC

( * ) Notice: Subject to any disclaimer, the term of this patent is extended or adjusted under 35 U.S.C. 154(b) by 0 days.

This patent is subject to a terminal disclaimer.

(21) Appl. No.: 14/942,813

(22) Filed: Nov. 16, 2015

(65) Prior Publication Data

US 2016/0135519 A1 May 19, 2016

Related U.S. Application Data

(63) Continuation-in-part of application No. 14/467,871, filed on Aug. 25, 2014, now Pat. No. 9,238,167.

(60) Provisional application No. 61/869,487, filed on Aug. 23, 2013.

(51) Int. Cl.

| | |
|---|---|
| ***A41D 13/05*** | (2006.01) |
| ***A63B 71/12*** | (2006.01) |
| ***A41D 27/26*** | (2006.01) |
| ***A41D 13/015*** | (2006.01) |

(52) U.S. Cl.

CPC ..... *A41D 13/0512* (2013.01); *A41D 13/015* (2013.01); *A41D 27/26* (2013.01); *A63B 71/12* (2013.01)

(58) Field of Classification Search

CPC A63B 71/12; A41D 13/0518; A41D 13/0531; F41H 1/02

USPC ..... 2/461, 462, 463, 467, 2.5, 102, 459

See application file for complete search history.

(56) References Cited

U.S. PATENT DOCUMENTS

| | | | | | |
|---|---|---|---|---|---|
| 3,158,871 | A | * | 12/1964 | Morgan | A63B 71/12 2/462 |
| 3,366,970 | A | * | 2/1968 | Morgan | A63B 71/12 2/462 |
| 3,431,560 | A | * | 3/1969 | Austin | A63B 71/12 2/462 |
| 3,981,027 | A | * | 9/1976 | Anderson | A63B 71/12 2/462 |
| 4,295,227 | A | * | 10/1981 | Mitchell | A63B 71/12 2/462 |

(Continued)

*Primary Examiner* — Tejash Patel

(74) *Attorney, Agent, or Firm* — Antonio Papageorgiou; Meister Seelig & Fein LLP

(57) ABSTRACT

A protective apparatus comprising a cantilever yoke system including a left arch slot, a right arch slot and one or more swivel slots, a left distal arch including attachment points configurable with the left arch slot of the cantilever yoke system, a left proximal arch including attachment points configurable with at least one of the attachment points of the left distal arch to join the left proximal arch to the left distal arch, a right distal arch including attachment points configurable with the right arch slot of the cantilever yoke system, a right proximal arch including attachment points configurable with at least one of the attachment points of the right distal arch to join the right proximal arch with the right distal arch, and a swivel including proximal arch slots configurable to join the left proximal arch with the right proximal arch.

18 Claims, 11 Drawing Sheets

(56) References Cited

U.S. PATENT DOCUMENTS

| | | | | | |
|---|---|---|---|---|---|
| 4,698,845 | A * | 10/1987 | Cosby | A63B 71/12 | 2/462 |
| 5,173,964 | A * | 12/1992 | Ball | A63B 71/12 | 2/267 |
| 7,506,384 | B2 * | 3/2009 | Ide | A63B 71/12 | 2/459 |
| 7,765,624 | B1 * | 8/2010 | Larson | A41D 27/26 | 2/459 |
| 8,214,929 | B2 * | 7/2012 | Kraemer | A63B 71/12 | 2/459 |
| 9,238,167 | B2 * | 1/2016 | Monica | A41D 13/015 | |

* cited by examiner

Fig. 4A
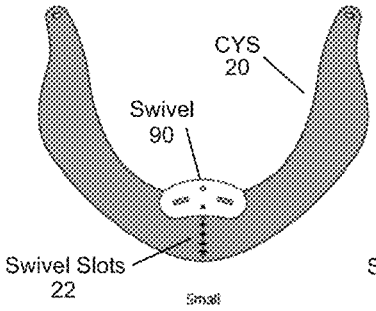
Fig. 4B
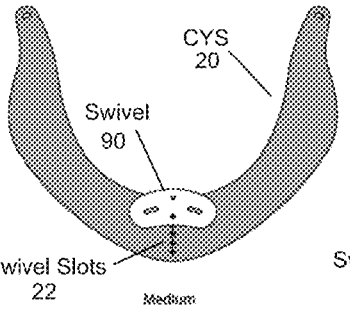
Fig. 4C
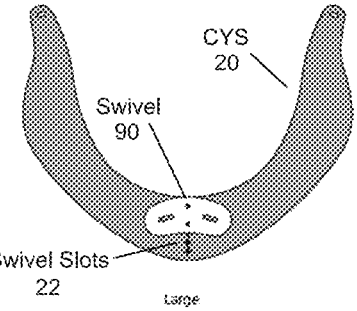
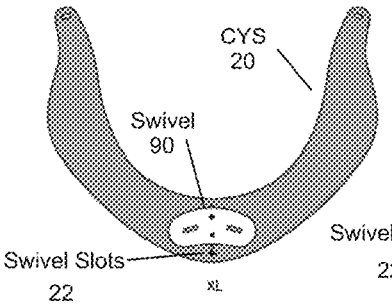
Fig. 4D
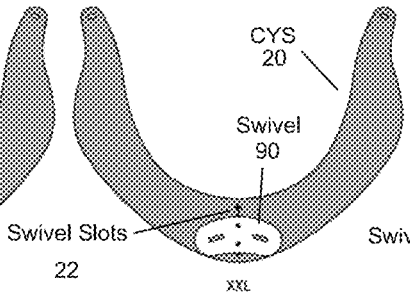
Fig. 4E
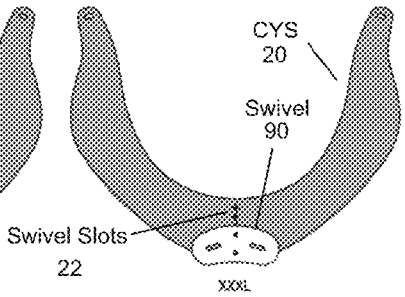
Fig. 4F Right Proximal Arch
60

Right Proximal Arch
60

Right Proximal Arch
60

Left Proximal Arch
40

Left Proximal Arch
40

Left Proximal Arch
40

Left Epualet
100
Left Cup
110

Left Shoulder Pad
70
Left Proximal Arch
40
Left Distal Arch
30
Right Proximal Arch
60
CYS
20
Right Shoulder Pad
80
Swivel
92
Right Distal Arch
50

Left Shoulder Pad
70
Left Distal Arch
30
Left Proximal Arch
40
CYS
20
Right Proximal Arch
60
Swivel
92
Right Shoulder Pad
80
Right Distal Arch
50

PROTECTIVE EQUIPMENT

CROSS REFERENCE TO RELATED APPLICATION

This application claims the priority of U.S. Provisional Application No. 61/869,487, entitled "PROTECTIVE EQUIPMENT," filed on Aug. 23, 2013, the disclosure of which is hereby incorporated by reference in its entirety.

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

Field of the Invention

The invention described herein generally relates to athletic protective equipment, and in particular, an improved athletic protective equipment construction for dispersing energy.

Description of the Related Art

Many contact sports require protective devices to guard against injury because of the violent bodily contact that is involved. One of the customary protective devices is a specialized piece of equipment in the form of shoulder pads which are traditionally worn over the shoulders. These types of shoulder pads have long been known and used. However, the high forces of impact which can be encountered when playing such sports has caused injuries due to the fact that the high force of impact is concentrated over the area of an impact, especially the acromioclavicular area of the shoulder. The concentration of the energy from the forces of impact transmitted to the acromioclavicular area of the shoulder by the conventional cantilever strap causes such shoulder injuries.

It should be noted that due to the nature of the sport of football, as well as other contact sports, no protective equipment, such as shoulder pads, can prevent injuries; however, it is believed that such equipment can be designed to attempt to better protect the player from injuries. Existing equipment do not adequately protect the player from the occurrence and severity of injuries to his shoulders, and particularly the acromioclavicular area of the player's shoulder. There is thus a need for protective equipment that disperses energy from contact throughout the entire shoulder pad, as opposed to a traditional cantilever which disperses energy on only one side of the shoulder pad.

SUMMARY OF THE INVENTION

In one aspect, a protective apparatus is provided that includes a cantilever yoke system having a left arch slot, a right arch slot and one or more swivel slots, the cantilever yoke system further having a shape that wraps around a back of a user and over the shoulders of the user; a generally arched shaped left portion coupled to the left arch slot of the cantilever yoke system at one or more attachment points located on a front of the arched shape left portion; a generally arched shaped right portion coupled to the right arch slot of the cantilever yoke system at one or more attachment points located on a front of the arched shaped right portion; and at least one swivel connecting the left and right portions of the apparatus to each other on a rear of the left and right portions, the cantilever yoke system further coupled to at least one of the at least one swivel on a rear of the apparatus, and a rear of at least one of the left and right portions.

In one embodiment, the left and right portions are pivotally coupled to each other and wherein slots in at least one of: the at least one swivel and the cantilever yoke system limit pivotal movement of the left and right portions.

In one embodiment, each of the left and right portions includes a distal and a proximal arch.

In one embodiment, the protective apparatus includes a plurality of shoulder pads, each coupled to the left and rights distal arches.

In one embodiment, the cantilever yoke system is fixedly coupled to the at least one swivel and slidingly coupled to the left and right portions of the apparatus to allow the left and right portions to move laterally relative to each other.

In one embodiment, the cantilever yoke system acts as a bridge between left and right portions of the apparatus to transfer the load from an impact on one of the left and right portions to the other of the left and right portions.

In one embodiment, the cantilever yoke system includes a left and a right end, each having an arch shape, and wherein the cantilever yoke system further includes a planer section located between the left and right arched shape ends of the system.

In one embodiment, the protective apparatus includes padding located on the cantilever yoke system in an interior of the apparatus.

In one embodiment, each of the left and right portions includes a distal and a proximal arch fixedly coupled to each other and wherein an apex of the proximal arch is located above an apex of the distal arch such that a space is maintained between the proximal and distal arches.

In one embodiment, the apex of each of the proximal and distal arches curves laterally outward such that apexes of the proximal and distal arches form an external cantilever system.

In another aspect, a protective apparatus is provided that includes: a cantilever yoke system having a left arch slot, a right arch slot and one or more swivel slots, the cantilever yoke system having a shape that wraps around a back of a user and over the shoulders of the user; a generally arched shaped left portion slidingly coupled to the left arch slot of the cantilever yoke system at one or more attachment points thereon located on a front of the arched shape left portion; a generally arched shaped right portion slidingly coupled to the right arch slot of the cantilever yoke system at one or more attachment points thereon located on a front of the arched shaped right portion; and at least one swivel connecting the left and right portions of the apparatus to each other on a rear of the left and right portions, the cantilever yoke system further fixedly coupled to the at least one swivel on a rear of the apparatus.

In one embodiment, the cantilever yoke system comprises a left and a right ends, each having an arch shape, and wherein the cantilever yoke system further includes a planer section located between the left and right arched shape ends of the system.

In one embodiment, the cantilever yoke system acts as a bridge between left and right portions of the apparatus to transfer the load from an impact on one of the left and right portions to the other of the left and right portions.

In one embodiment, the left and right portions are pivotally coupled to each other and wherein slots in at least one of: the at least one swivel and the cantilever yoke system limit pivotal movement of the left and right portions.

In one embodiment, each of the left and right portions comprises a distal and a proximal arch.

In one embodiment, the protective apparatus includes a plurality of shoulder pads, each coupled to the left and rights distal arches.

In one embodiment, the protective apparatus includes padding located on the cantilever yoke system in an interior of the apparatus.

In one embodiment, each of the left and right portions include a distal and a proximal arch fixedly coupled to each other and wherein an apex of the proximal arch is located above an apex of the distal arch such that a space is maintained between the proximal and distal arches, and wherein the apex of each of the proximal and distal arches curves laterally outward such that apexes of the proximal and distal arches for an external cantilever system.

BRIEF DESCRIPTION OF THE DRAWINGS

The invention is illustrated in the figures of the accompanying drawings which are meant to be exemplary and not limiting, in which like references are intended to refer to like or corresponding parts, and in which:

FIG. 4A through 4F illustrate swivel configurations on cantilever yoke systems according to embodiments of the present invention;

DETAILED DESCRIPTION OF THE INVENTION

Subject matter will now be described more fully hereinafter with reference to the accompanying drawings, which form a part hereof, and which show, by way of illustration, exemplary embodiments in which the invention may be practiced. Subject matter may, however, be embodied in a variety of different forms and, therefore, covered or claimed subject matter is intended to be construed as not being limited to any example embodiments set forth herein; example embodiments are provided merely to be illustrative. It is to be understood that other embodiments may be utilized and structural changes may be made without departing from the scope of the present invention. Likewise, a reasonably broad scope for claimed or covered subject matter is intended. The following detailed description is, therefore, not intended to be taken in a limiting sense.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of exemplary embodiments in whole or in part.

Figure 1:
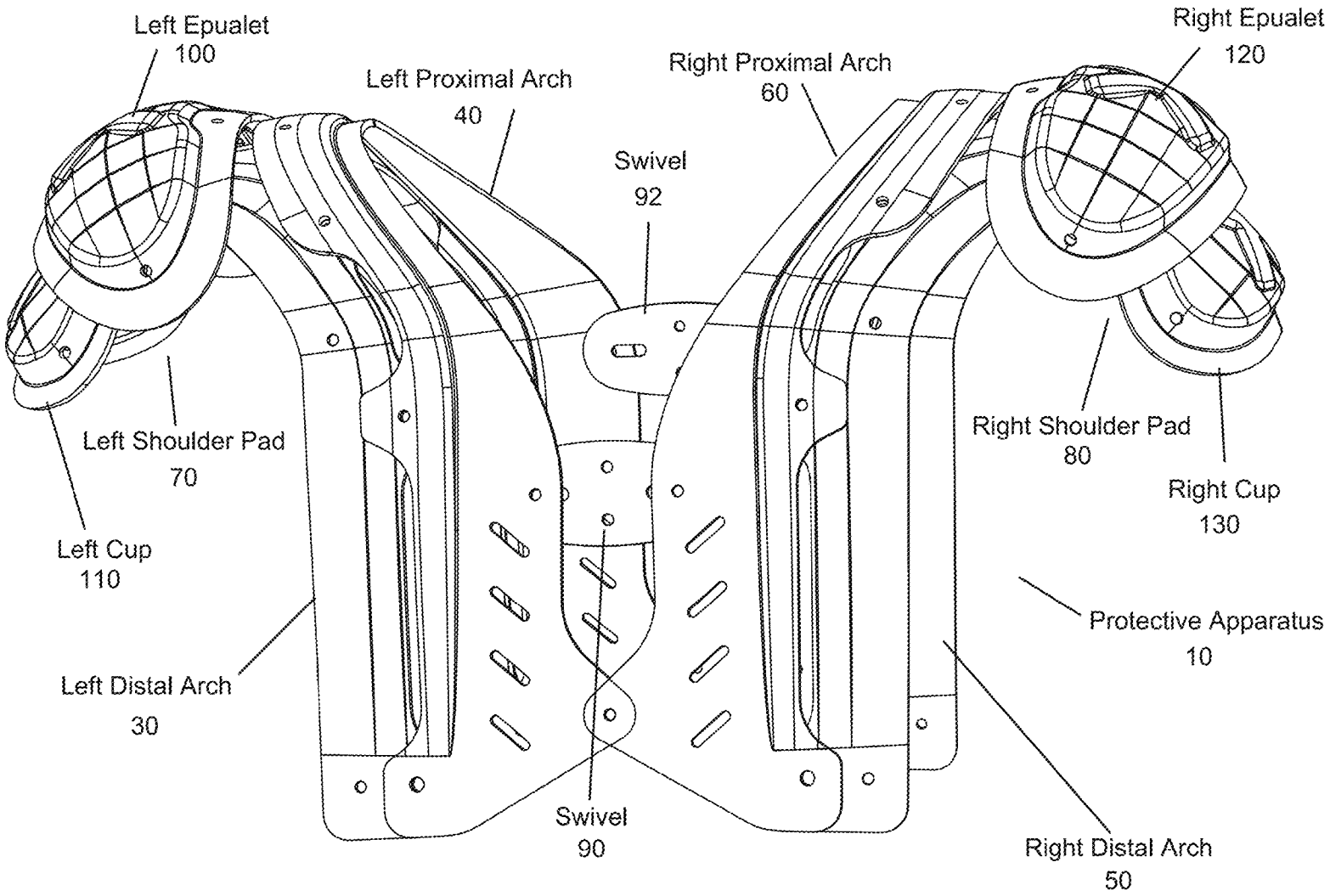
FIG. 1 illustrates a rear-right perspective view of a protective apparatus according to an embodiment of the present invention.

FIG. 1 presents a perspective view of the protective apparatus 10 according to an embodiment of the present invention. The protective apparatus 10 includes a left distal arch 30, a left proximal arch 40, right distal arch 50, right proximal arch 60, left shoulder pad 70 and right should pad 80. The proximal and distal arches are preferably fixedly coupled to each other. Left shoulder pad 70 is comprised of left epaulet 100 and left cup 110. Right shoulder pad 80 is comprised of right epaulet 120 and right cup 130. Left shoulder pad 70, left distal arch 30 and left proximal arch 40 may be coupled to form a left portion of protective apparatus 10. Right shoulder pad 80, right distal arch 50 and right proximal arch 60 may be coupled to form a right portion of protective apparatus 10. The left and right portions of protective apparatus 10 can be joined via a swivel 90 and swivel 92 which allow the portions to move closer and farther away from each other laterally (from left to right and right to left). The two portions of the apparatus 10 may also be hinged to each other. In this instance, the swivel 90 and/or 92 limit the lateral and consequently the pivotal movement of the left and right portions.

Figure 2:
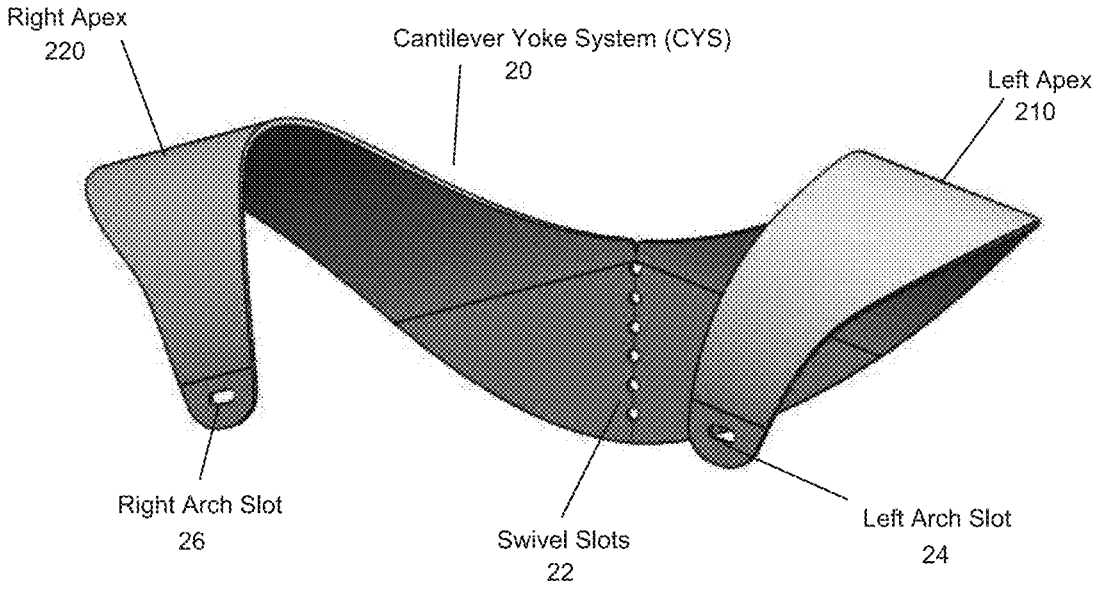
FIG. 2 illustrates a cantilever yoke system according to an embodiment of the present invention.

The protective apparatus according to another embodiment includes a one-piece cantilever yoke system 20 ("CYS") illustrated in FIG. 2, which acts as a bridge between the left and right shoulder structures of protective apparatus 10. That is, the system 20 is sufficiently rigid to spread the load from an impact on one of the left and right portions of the apparatus to the other of the portions. The CYS 20 may extend over the collar, shoulders and back of a user. CYS 20 includes left arch slot 24, right arch slot 26 and swivel slots 22 (which allow the left and right portions to move lateral). According to one embodiment, the CYS 20 is comprised of a plastic material such as high-density polyethylene (HDPE), which may be approximately 0.63 inches thick (or ranging from 0.5 through 0.75 inches in thickness), and that conforms to the shape of the protective equipment. That is, the system 20 includes left and right ends each having arched shape similar to the generally arched shaped left and right portions. A generally planer section is located between the left and right arched shaped ends of the system 20. The CYS 20 is capable of wrapping around both shoulders of a user and is configurable to attach to the front of left distal arch 30 and right distal arch 50 via left arch slot 24 and right arch slot 26, respectively.

Figure 3:
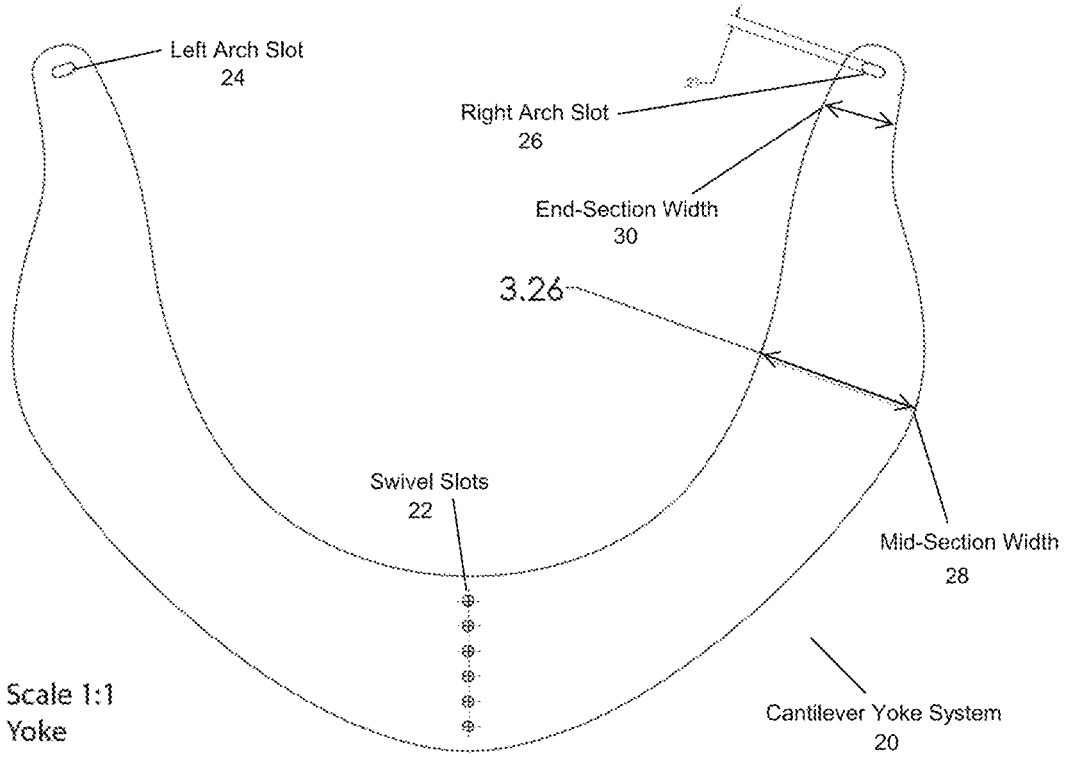
FIG. 3 illustrates a cantilever yoke system according to another embodiment of the present invention.

FIG. 3 presents exemplary dimensions for CYS 20. CYS 20 may be symmetrical in shape, dimension and features about the left and right sides of swivel slots 22. A mid-section width 28 of the right side portion of CYS 20 may be approximately 3.26 inches in width and reduces to about half the width at end-section width 30. The left side portion of CYS 20 may include an identical or substantially similar mid-section width and end-section width. CYS 20 further includes a left arch slot 24 and a right arch slot 26 that are flatten oval-shaped and may measure approximately 0.21 inches in width (between the flattened edges).

Swivel 90 may be attached to CYS 20 via swivel slots 22. FIG. 4A through FIG. 4F present exemplary configurations of swivel 90 with CYS 20 for use with various sizes of protective apparatus 10. The swivel 90 may be connected to the back of left proximal arch 40 and right proximal arch 60. Connection points of CYS 20 (e.g., attachment to swivel slots 22, left arch slot 24, and right arch slot 26) may be attached using stainless steel semi tubular rivets and stainless steel washers, allowing each point of CYS to move freely with exterior shell of pad. Other mechanisms or attachment means for attaching the CYS (such as screws, nuts and bolts, snaps, etc.) that are well-known in the art are also contemplated as falling within the scope of the present invention.

Referring back to FIG. 2, half inch twelve pound density shoulder pads and/or a half inch nine pound density foam body portion are attachable to the bottom of CYS 20 at left apex 210 and right apex 220, although other densities may be incorporated therein. The foam body portions may be removably attached to the bottom of the CYS 20, for example, using hook and loop fasteners. This beneficially allows the foam pads to be adjusted to accommodate that anatomy of various users. In at least one embodiment, the dual density foam pads are used. That is, the pads may be comprised of a plurality of different density foam layers, e.g., at 25 lb. layer laminated to a 9 lb. layer. The exterior of the shoulder pads, e.g., left and right Epualets, cups, arches, etc., may be laminated with high density foam. Moreover, the foam may be laminated with a low friction membrane. The foam/low friction membrane is preferably fixedly laminated onto the shoulder pads. The CYS provides an integral part of the protective apparatus 10 and acts as an interior harness for most vital areas of the user. The one piece CYS disperses energy from contact throughout the entire shoulder pad, as opposed to a traditional cantilever which disperses energy on only one side of the shoulder pad. Incorporating CYS 20 on a three-point swivel allows the foam shoulder of the pad to take on the same plain as the players shoulders, further allowing the shoulder pad in its entirety to disperse energy 360 degrees from a point of contact.

By separating the front pads from the back pads on both the right and left side of inner foam body allows the protective apparatus 10 to form a natural channel around a player's shoulder that is accompanied by adjustable shoulder piece. Adjustable shoulder piece can be moved to best fit the makeup of a player's shoulder measurements. Furthermore, using a quarter to half an inch of foam in body and shoulder foam with certain embodiments allows the protective apparatus 10 to have one inch of foam at a point of highest probability of impact (anterior portion of shoulder) by layering body foam with shoulder foam. Separation of front from back foam also allows the protective apparatus 10 to place body foam on top of the shoulder foam piece by directly attaching to the cantilever yoke system 20. Inversely, a body of foam can be placed underneath shoulder foam where shoulder foam is directly attached to cantilever yoke system 20.

FIG. 4A through 4F present swivel configurations on cantilever yoke systems according to embodiments of the present invention. Swivel configurations may vary depending on a size configuration of protective apparatus 10. The swivel 90 may be attached to one or more swivel slots 22 on CYS 20.

The protective apparatus according to embodiments of the present invention may include a two piece arch system, which creates a single arch that allows both left and right arches to have a spine built from corrugation to run from front of a given arch to back of the given arch that in turn strengthens the shoulder pad. Furthermore the proximal and distal arches allow for an outside cantilever, as there is a space between the proximal and distal arch at apex of arch. Having a two piece arch allows one to change the style of the pad (e.g., the cut) by only adjusting the shape of the distal arch while maintaining integrity and/or strength of the arch. The left proximal and distal arches may be identical, substantially identical, or minor right proximal and distal arches.

By raising the apex of outwardly curving proximal arch, e.g., ⅜ of an inch above the apex distal arch, it creates an exterior cantilever system on both the left and right side of pad that dissipates energy from contact away from apex of arch, thus lessening pressure in the shoulder area upon impact. The way the two piece arches have been cut has allowed the protective apparatus to integrate two natural ventilation areas in the front and back, left and right side of pad. Integrated quarter and half inch corrugation bars may run vertically throughout entire arch, which enables the protective apparatus to use a thinner HDPE (e.g., falling between 0.125" and 0.188"), thereby cutting weight of product while maintaining strength of arches.

Figure 5:
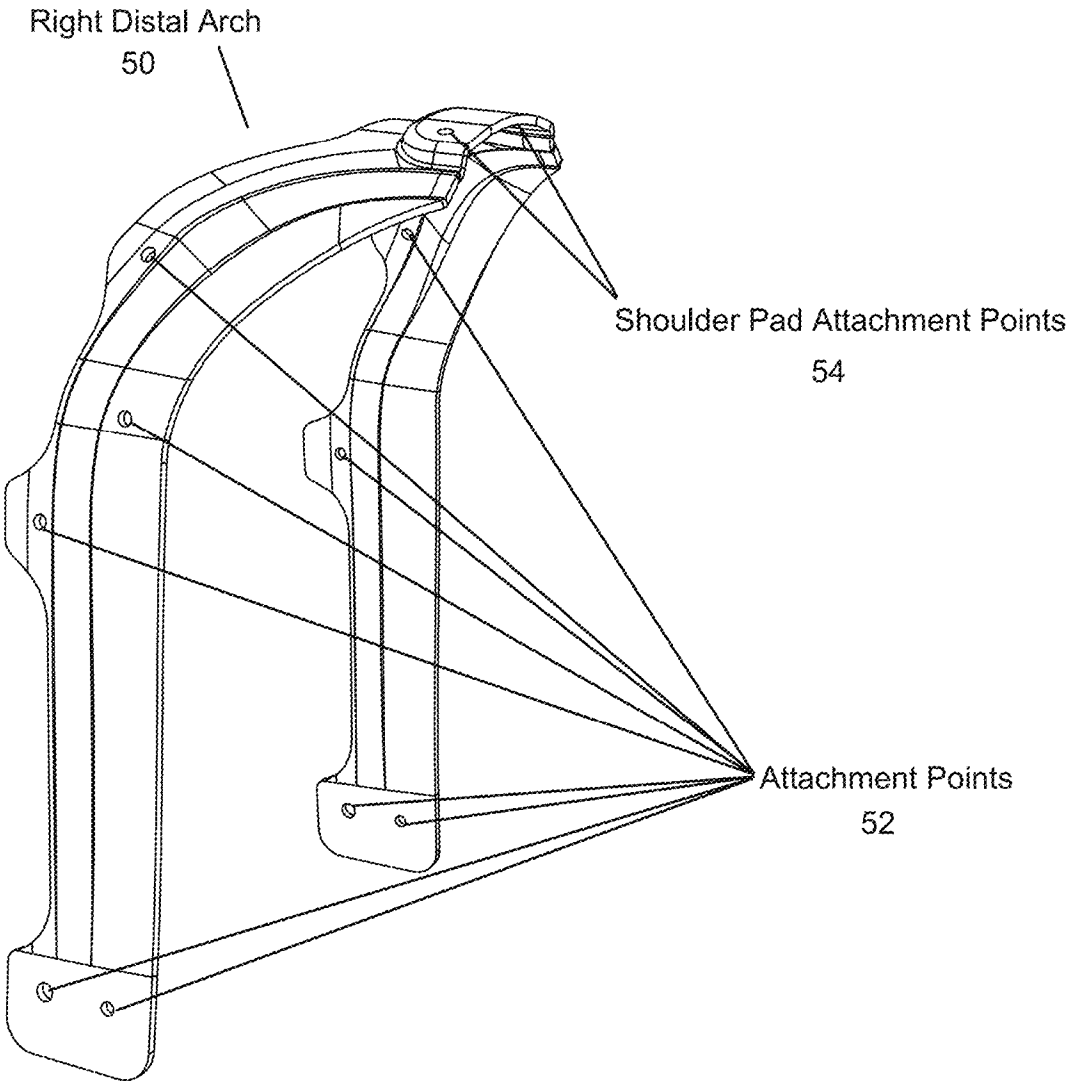
FIG. 5 illustrates a right distal arch according to an embodiment of the present invention.
Figure 9A:
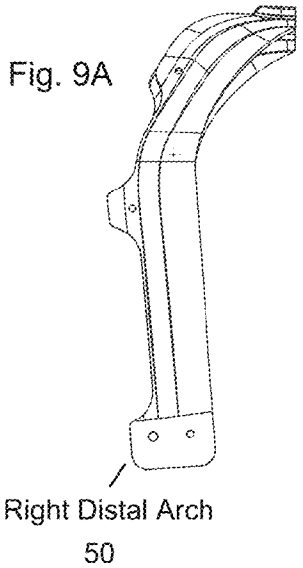
FIG. 9A through FIG. 9C illustrate a right distal arch according to an embodiment of the present invention.
Figure 9B:
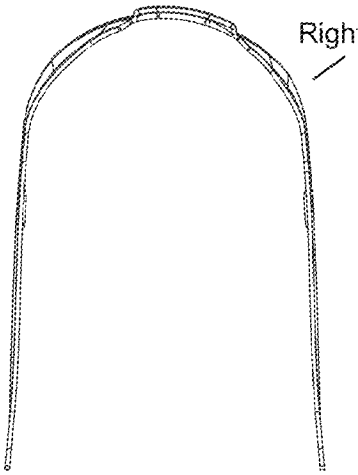
Figure 9C:
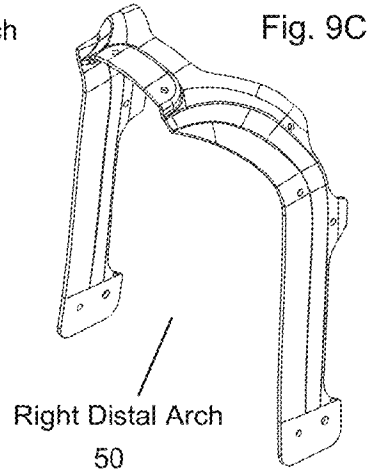
Figure 10A:
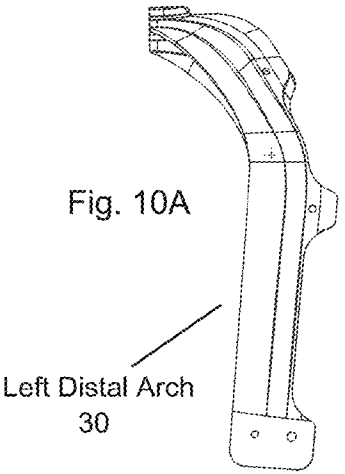
FIG. 10A through FIG. 10C illustrate a left distal arch according to an embodiment of the present invention.
Figure 10B:
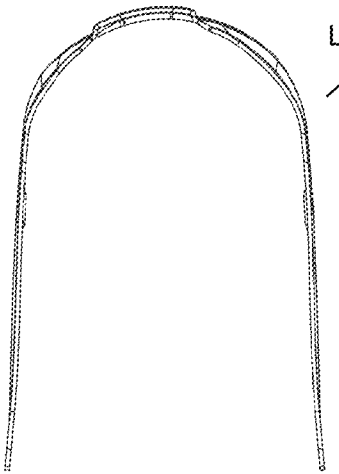
Figure 10C:
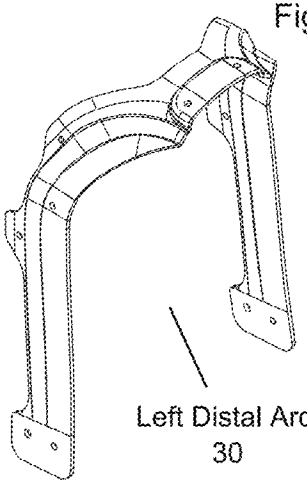
Figure 11:
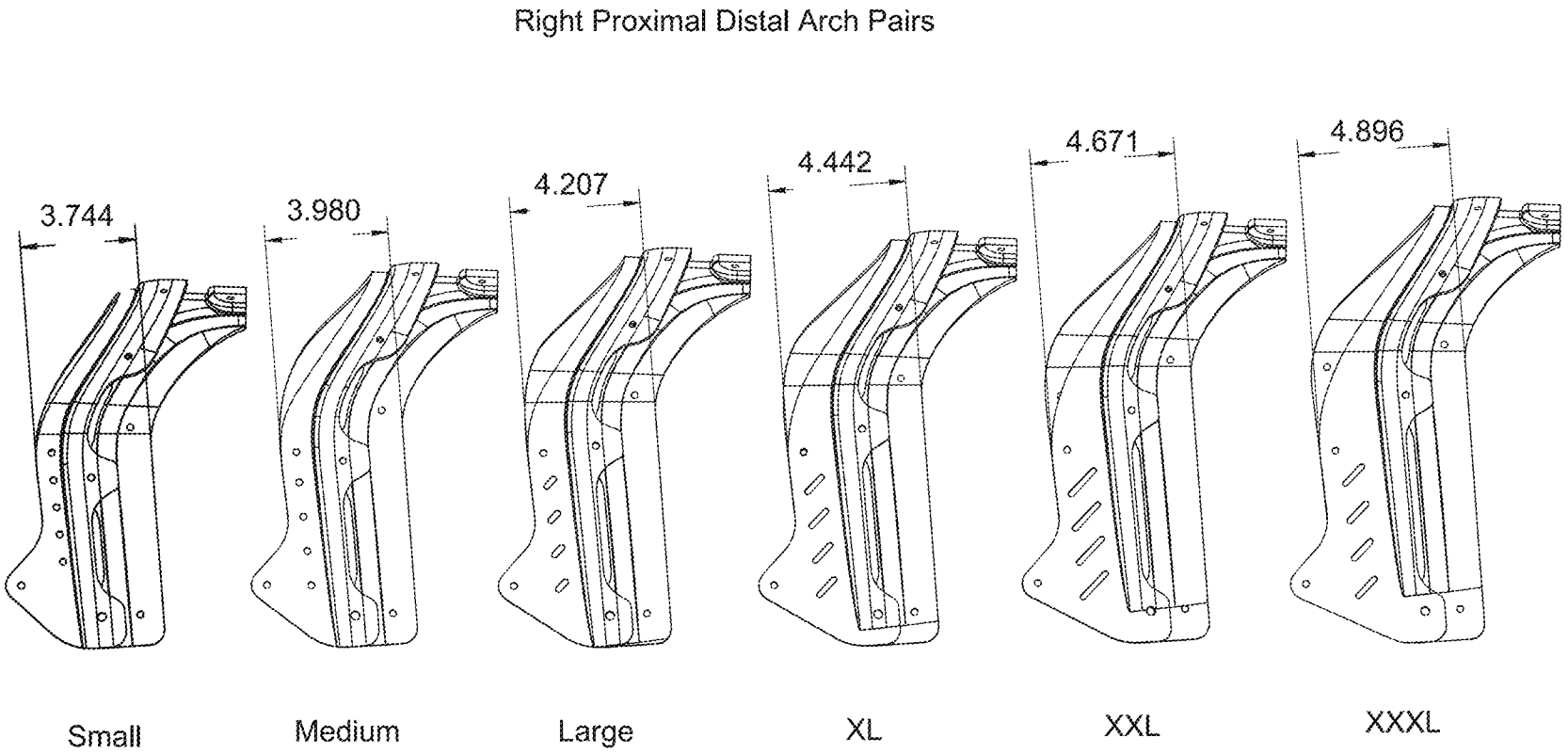
FIG. 11 illustrate right proximal distal arch pairs according to embodiments of the present invention.

FIG. 5 presents a right distal arch 50 according to an embodiment of the present invention. Right distal arch 50 includes a plurality of attachment points 52 and shoulder pad attachment points 54. The right distal arch 50 may be attached with right proximal arch 60 (and CYS 20) at attachment points 52 and secured with attachment means to form a right proximal distal arch pair, as illustrated in FIG. 11. Similarly, attachment means may be used to secure an attachment of right shoulder pad 80 to right distal arch 50 at shoulder pad attachment points 54. Left distal arch 30 may include corresponding features as right distal arch 50 but in opposite or mirror-symmetrical construction. FIG. 9A through FIG. 9C present additional views of right distal arch 50 according to an embodiment of the present invention. FIG. 10A through FIG. 10C present views of a corresponding left distal arch 30 according to an embodiment of the present invention.

Figure 6:
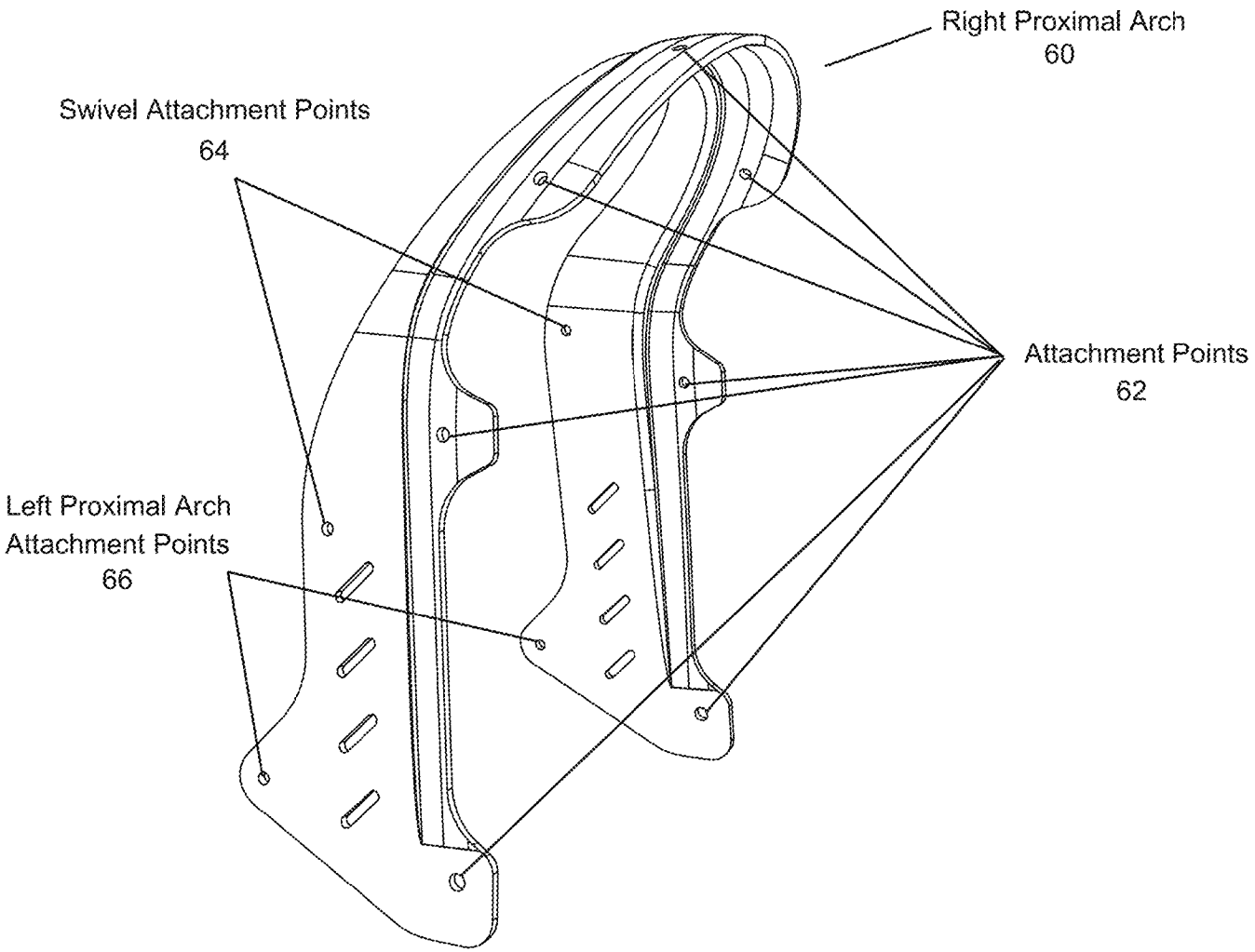
FIG. 6 illustrates a right proximal arch according to an embodiment of the present invention.
Figures 7A, 7B, 7C, 8A, 8B, 8C:
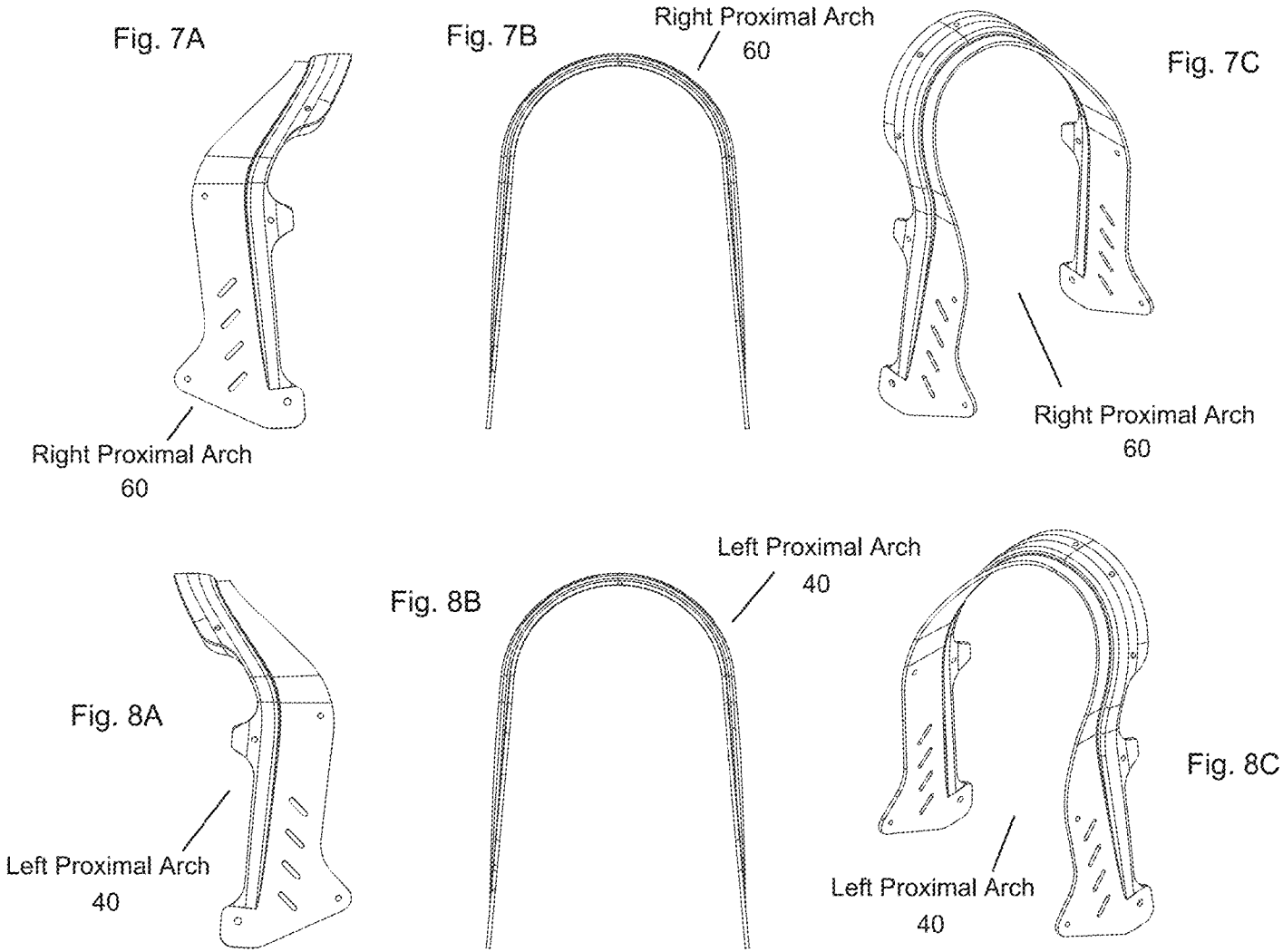
FIG. 7A through FIG. 7C illustrate a right proximal arch according to an embodiment of the present invention.
FIG. 8A through FIG. 8C illustrate a left proximal arch according to an embodiment of the present invention.

FIG. 6 illustrates a right proximal arch 60 according to an embodiment of the present invention. Right proximal arch 60 includes a plurality of attachment points 62 that provides a securing point with attachment points 52 of right distal arch 50 (which is also attached to CYS 20) using attachment means. Swivel attachment points 64 of right proximal arch 60 may be secured to proximal arch slots on one end of swivel 90 (e.g., on the rear) and swivel 92 (e.g., on the front) also using attachment means. Similarly, attachment means may be used at proximal arch slots on the other end of swivel 90 and swivel 92 to secure an attachment to corresponding swivel attachment points of left proximal arch 40. Right proximal arch 60 further includes left proximal arch attachment points 66 for attachment to corresponding proximal arch attachment points on left proximal arch 40. Left proximal arch 40 may include features and elements of right proximal arch 60 in mirror symmetry. For example, left proximal arch 40 may include a plurality of attachment points for securing with attachment points of left distal arch 30, swivel attachment points, and right proximal arch attachment points to secure an attachment with right proximal arch 60 at the left proximal arch attachment points 66. FIG. 7A through FIG. 7C present additional views of right proximal arch 60 according to an embodiment of the present invention. FIG. 8A through FIG. 8C present views of a corresponding left proximal arch 40 according to an embodiment of the present invention.

Bottom portions of proximal arches 40 and 60 in the front and back may act as an axis by joining extended triangle areas of left and right proximal arches together via attachment means. Attachment means may include stainless steel semi tubular rivet and stainless steel washer and spacer that are used to allow left and right side of pad to move freely, although other mechanisms may be utilized as known to those of skill in the art. The front and back triangle of one proximal arch may be slightly raised above the proximal arch on the opposing side. This allows entire pad to maintain a proper fit and lie flat amongst player's torso. The swivel 90 acts as a bridge between the left and right proximal arches and provides a three-point swivel system for the left and right proximal distal arch pairs. Upon impact it allows both left and right side padding to move simultaneously with the cantilever yoke system 20 and lock into place at end point of slots. This ensures that inner body of pad lies flat against a player's body and that the shoulder pads returns back to original form post-impact.

FIG. 11 presents right proximal distal arch pairs according to exemplary embodiments of the present invention. Right proximal arch 60 may be attached to right distal arch 50 to form a right proximal distal arch pair, as described with respect to FIG. 5 and FIG. 6. A given midsection width of the proximal distal arch pairs may vary according to user sizes. For example, the illustrated midsection width for a small user or a "small" configuration for protective apparatus 10 is approximately 3.744 inches. Approximate midsection width for medium is 3.980 inches, 4.207 for large, 4.442 for XL, 4.671 for XXL, and 4.896 for XXXL.

Figure 12A:
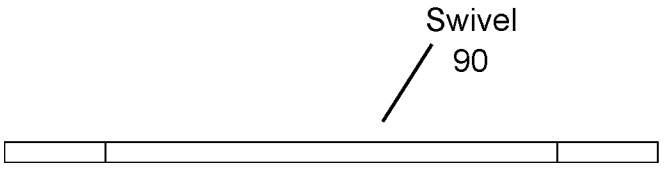
FIG. 12A illustrates a side view of a swivel according to an embodiment of the present invention.
Figure 12B:
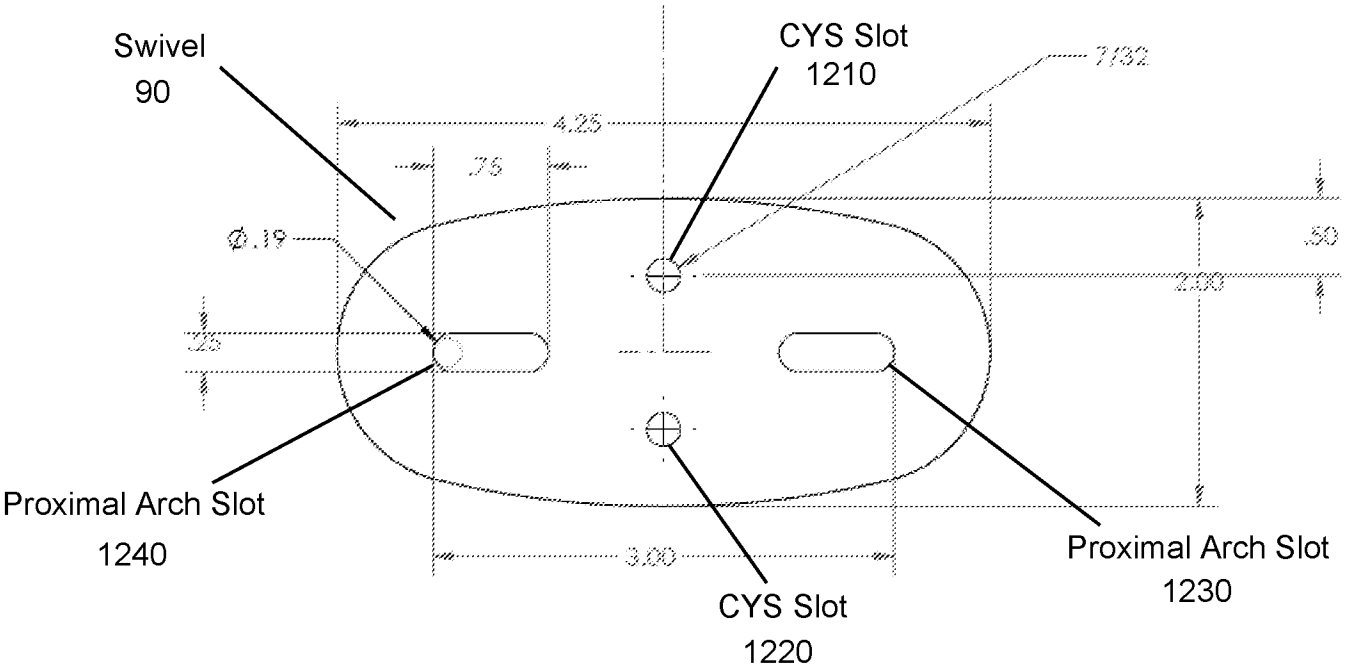
FIG. 12B illustrates a top view of a swivel according to an embodiment of the present invention.

FIG. 12A presents a side view of a swivel and FIG. 12B illustrates a top view of the swivel according to an embodiment of the present invention. Swivel 90 includes proximal arch slot 1230, proximal arch slot 1240, CYS slot 1210 and CYS slot 1220. Swivel 90 may be approximately 4.25 inches in width and approximately two inches in height. Attachment means may be configured at proximal arch slots 1230 and 1240 to secure an attachment with swivel attachment points of left proximal arch 40 and swivel attachment points of right proximal arch 60.

Figures 13A, 13B, 13C:
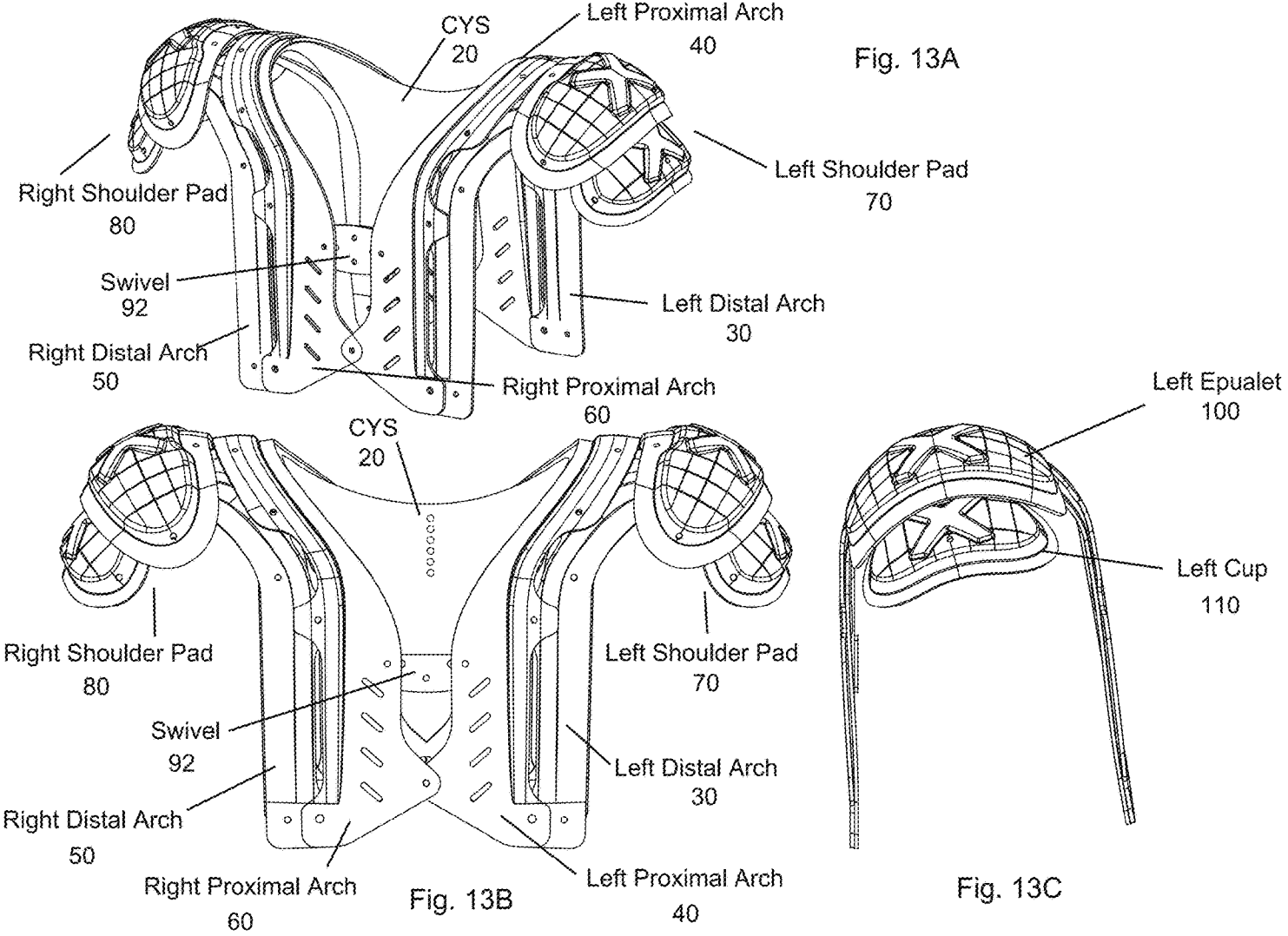
FIG. 13A illustrates a front-left perspective view of a protective apparatus according to an embodiment of the present invention.
FIG. 13B illustrates a front view of a protective apparatus according to an embodiment of the present invention.
FIG. 13C illustrates a side view of a protective apparatus according to an embodiment of the present invention.

Proximal arch slots 1230 and 1240 may be approximately 0.75 inches in width, 0.25 inches in height, and centered along the axis of the width. Attachment means with a diameter of approximately 0.19 inches may be insertable through proximal arch slots 1230 and 1240. Outside edge distance between proximal arch slot 1230 and proximal arch slot 1240 may be approximately three inches. CYS slot 1210 and CYS slot 1220 may be configured with attachment means to secure with CYS 20 as illustrated in FIG. 4. CYS slots 1210 and 1220 may be comprised of a circular opening including an approximate diameter of 7/32 inches and centered along the axis of the height. The center point of CYS slots 1210 and 1220 may also be offset from the edge of the height by approximately half an inch. According to at least one embodiment, swivel 92 may be identical or similarly scaled to the features and dimensions of swivel 90. In another embodiment, swivel 92 may include a single CYS slot as illustrated in FIG. 15 and FIG. 13B. According to other alternative embodiments, swivel 90 and/or swivel 92 may include any number of CYS slots (e.g., 1, 2, 3, etc.) and any even number of proximal arch slots.

FIG. 13A illustrates a front-left perspective view of a protective apparatus according to another embodiment of the present invention. FIG. 13B illustrates a front view of a protective apparatus according to yet another embodiment of the present invention. FIG. 13C illustrates a side view of a protective apparatus according to an embodiment of the present invention.

FIGS. 1 through 13C are conceptual illustrations allowing for an explanation of the present invention. Notably, the figures and examples above are not meant to limit the scope of the present invention to a single embodiment, as other embodiments are possible by way of interchange of some or all of the described or illustrated elements. Moreover, where certain elements of the present invention can be partially or fully implemented using known components, only those portions of such known components that are necessary for an understanding of the present invention are described, and detailed descriptions of other portions of such known components are omitted so as not to obscure the invention. In the present specification, an embodiment showing a singular component should not necessarily be limited to other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

The foregoing description of the specific embodiments will so fully reveal the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s).

While various embodiments of the present invention have been described above, it should be understood that they have been presented by way of example, and not limitation. It would be apparent to one skilled in the relevant art(s) that various changes in form and detail could be made therein without departing from the spirit and scope of the invention. Thus, the present invention should not be limited by any of the above-described exemplary embodiments, but should be defined only in accordance with the following claims and their equivalents.

The invention claimed is:

1. The protective apparatus comprising:

a plurality of generally arched shaped portions, at least one of the portions comprising:

a distal arch coupled to a proximal arch, and at least one shoulder pad coupled to the distal arch, wherein the plurality of generally arched portions comprise left and right portions pivotally coupled to each other.

2. The protective apparatus of claim 1, comprising a cantilever yoke system having a left arch slot, a right arch slot and one or more swivel slots, and one or more swivels, and wherein slots in at least one of: the one or more swivels and the cantilever yoke system limit pivotal movement of the left and right portions.

3. The protective apparatus of claim 2, wherein the one or more swivels connect the left and right portions of the apparatus to each other on a rear of the left and right portions, the cantilever yoke system further coupled to at least one of the one or more swivels on a rear of the apparatus at the one or more swivel slots.

4. The protective apparatus of claim 3 wherein the cantilever yoke system is fixedly coupled to the one or more swivels and slidingly coupled to the left and right portions of the apparatus to allow the left and right portions to move laterally relative to each other.

5. The protective apparatus of claim 4 wherein the cantilever yoke system acts as a bridge between left and right portions of the apparatus to transfer the load from an impact on one of the left and right portions to the other of the left and right portions.

6. The protective apparatus of claim 5 wherein the cantilever yoke system has a thickness of about 0.5 inches to about 0.75 inches.

7. The protective apparatus of claim 4 wherein the cantilever yoke system comprises a left and a right end, each having an arch shape, and wherein the cantilever yoke system further comprises a planer section located between the left and right arched shape ends of the system.

8. The protective apparatus of claim 7 comprising padding located on the cantilever yoke system in an interior of the apparatus.

9. The protective apparatus of claim 1 wherein each of the left and right portions comprise a distal and a proximal arch fixedly coupled to each other and wherein an apex of the proximal arch is located above an apex of the distal arch such that a space is maintained between the proximal and distal arches.

10. The protective apparatus of claim 9, wherein the apex of each of the proximal and distal arches curves laterally outward such that apexes of the proximal and distal arches form an external cantilever system.

11. A protective apparatus comprising:

a cantilever yoke system having a left arch slot, a right arch slot and one or more swivel slots;

a generally arched shaped left portion slidingly coupled to the left arch slot of the cantilever yoke system at one or more attachment points thereon located on a front of the arched shape left portion;

a generally arched shaped right portion slidingly coupled to the right arch slot of the cantilever yoke system at one or more attachment points thereon located on a front of the arched shaped right portion; and at least one swivel connecting the left and right portions of the apparatus to each other on a rear of the left and right portions.

12. The protective apparatus of claim 11 wherein the cantilever yoke system comprises a left and a right ends, each having an arch shape, and wherein the cantilever yoke system further comprises a planer section located between the left and right arched shape ends of the system.

13. The protective apparatus of claim 12, wherein the cantilever yoke system acts as a bridge between left and right portions of the apparatus to transfer the load from an impact on one of the left and right portions to the other of the left and right portions.

14. The protective apparatus of claim 12, wherein the cantilever yoke system has a thickness of about 0.5 inches to about 0.75 inches.

15. The protective apparatus of claim 11, wherein the left and right portions are pivotally coupled to each other and wherein slots in at least one of: the at least one swivel and the cantilever yoke system limit pivotal movement of the left and right portions.

16. The protective apparatus of claim 11 wherein each of the left and right portions comprise a distal and a proximal arch.

17. The protective apparatus of claim 16 comprising a plurality of shoulder pads, each coupled to the left and rights distal arches.

18. The protective apparatus of claim 11 comprising padding located on the cantilever yoke system in an interior of the apparatus.

* * * * *